United States Patent [19]

Roberts

[11] 4,290,148

[45] Sep. 22, 1981

[54] SURGICAL GOWN

[76] Inventor: Fred A. Roberts, 428 Beverly, Lake Forest, Ill. 60045

[21] Appl. No.: 130,230

[22] Filed: Mar. 14, 1980

[51] Int. Cl.[3] ..... A41B 13/10

[52] U.S. Cl. ..... 2/51

[58] Field of Search ..... 2/51, 52, DIG. 7, 114

[56] References Cited

U.S. PATENT DOCUMENTS

| | | | |
|---|---|---|---|
| 3,803,640 | 4/1974 | Ericson | 2/51 |
| 3,864,757 | 2/1975 | Hartigan | 2/DIG. 7 |
| 3,977,025 | 8/1976 | Horan | 2/114 |
| 4,000,521 | 1/1977 | Zoephel | 2/DIG. 7 |
| 4,016,604 | 4/1977 | Welke | 2/51 |
| 4,019,207 | 4/1977 | Newman et al. | 2/51 |
| 4,075,716 | 2/1978 | Collins | 2/114 |

*Primary Examiner*—Doris L Troutman

*Attorney, Agent, or Firm*—Robert E. Wagner; Ralph R. Rath

[57] ABSTRACT

A disposable surgical gown is disclosed having a body portion and two side panels. Interior tie strings secure the gown to the wearer's body and the back is closed through mating fastening means on each side panel. The side panels are brought together to engage the fastening means through pull tabs overlaying the fastening means on the overlapping side panel. The pull tabs are removable from the side panel after use, thereby eliminating any contact with the gown itself in putting the gown on for retention of sterility of the gown.

11 Claims, 6 Drawing Figures

FIG. 1
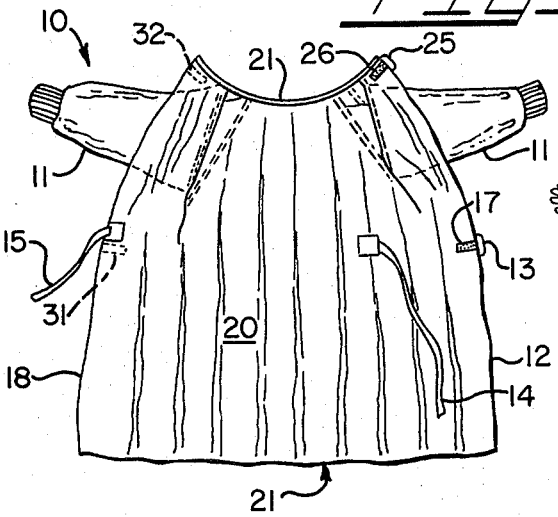
FIG. 2
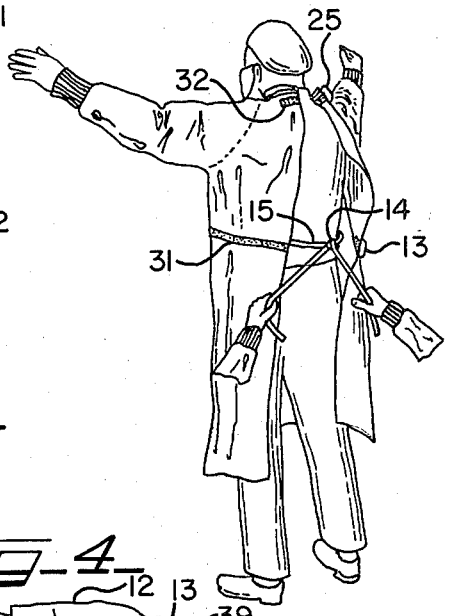
FIG. 3
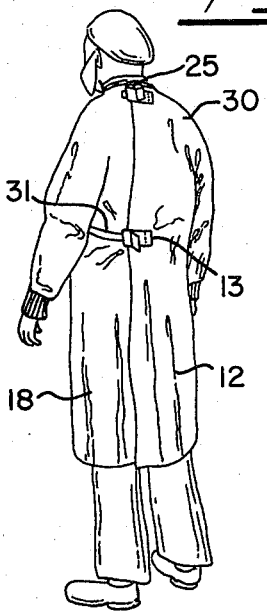
FIG. 4
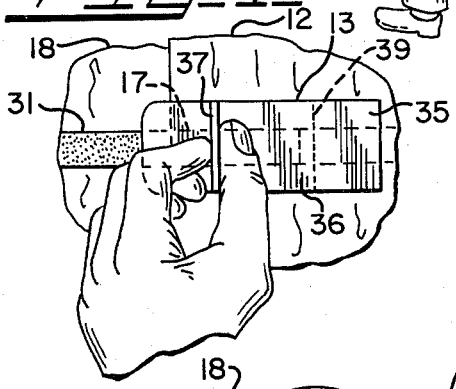
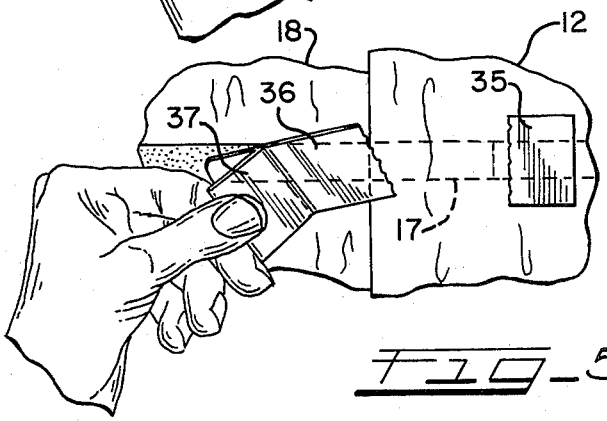
FIG. 5
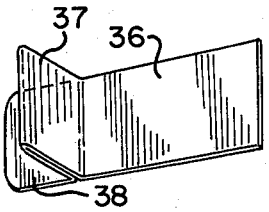
FIG. 6

SURGICAL GOWN

DESCRIPTION

1. Technical Field

The subject invention relates to disposable surgical gowns and, more particularly, to a means of allowing the aseptic donning of surgical gowns.

2. Background of the Prior Art

Operating room gowns generally have a closed back for the prevention of contamination of the front of the gown; such gowns are known as sterile back-closing gowns. In general, sterile back-closing gowns are secured to the wearer (the surgeon or nurse as may be the case) by outer belts which are tied for a snug fit on the waist area. Surgical gowns generally have full sleeves and are of full length, i.e., extending from the neck to the knees of the wearer. The predominate concern of the wearer of a surgical gown is that he or she maintain his or her aseptic condition in putting the surgical gown on and during closure. Thus, contaminated surfaces may not contact gown surfaces that are, in fact, sterile and have the possibility of being contaminated. Because of the importance in maintaining such aseptic conditions, it is generally accepted that the wearer of the surgical gown require the assistance of another person to put on the gown. The circulating nurse generally assumes these duties. As she is not generally in an aseptic condition, it is important that means be provided for allowing the circulating nurse to assist others in putting on the surgical gown without allowing for contamination or the possibility of contamination of the gown.

By the use of disposable gowns, hospitals have been able to greatly cut down laundry expenses. For these reasons, disposable gowns have recently become highly desirable.

Certain disposable gowns of the prior art by which asepsis has been maintained utilize a belt and transfer case or transfer bag having one relatively short tie string secured to the front surface of one side of the gown and a longer tie string attached near the outer edge of the back surface of the same side. The longer tie string has a protective pull-off tab or card at its free end by which it may be grabbed by the circulating nurse without breaking the aseptic condition. The longer tie string is pulled around the surgeon by the nurse to close the sterile back of the gown. The nurse gives the tie string to the surgeon who grasps the tie string while the circulating nurse pulls the protective tab off. The surgeon then ties the belt, thereby securing the surgical gown in place without breaking asepsis. Such a disposable surgical gown is described in U.S. Pat. No. 4,075,716. Another surgical gown of the prior art utilizing a protective device for maintaining aseptic conditions when manipulating the ties of the belt can be found in U.S. Pat. No. 3,935,596. However, certain drawbacks experienced in the case of external ties, such as being a source of lint on the surgeon's glove and providing for an uncomfortably warm garment, have limited the success of such disposable gowns. While the inner ties allow better circulation and thus provide for a cooler garment, prior to now difficulties have been present in retaining asepsis when closing the gown.

SUMMARY OF THE INVENTION

Therefore, an object of the subject invention is an improved surgical gown which may be put on by a surgeon with the aid of a non-sterile person and yet easily maintain a sterile front and back outer surface of the gown.

A further object of the subject invention is a surgical gown having a hook and loop tape closure with removable tabs to aid in putting on a gown while confining all non-sterile handling to the removable tabs.

These and other objects are attained in accordance with the present invention wherein there is provided a surgical gown having a front panel, two side panels, and adjustable inner closure ties for securing the gown at the wearer's waist. The rear side portions of the surgical gown overlap each other. At the top of each rear side portion of the gown by the neck opening are mating hook and loop fastening strips, one fastening strip being on a rear side portion while on the opposite and facing side portion of the surgical gown a mating fastening strip is secured. On the outer overlapping said portion of the gown, an upstanding tab is removably attached. Upon tying the interior ties, the removable tap is grasped and manipulated to bring the overlapping side portion into alignment with the inner side portion for contact of the respective fastening strips until they are secured to one another, thereby closing the rear of the gown. The removable tab is torn away from its position on the surgical gown leaving the surgical gown in an aseptic condition and securely on the wearer.

BRIEF DESCRIPTION OF THE DRAWINGS

Further objects of the invention, together with features contributing thereto and advantages accruing therefrom will become apparent upon the following description of one embodiment of the invention when read in conjunction with the accompanying drawings wherein:

FIG. 1 is a plan view of the gown of the subject invention showing the inside gown surface;

FIG. 2 is a perspective view of a wearer in the initial stages of putting the gown of the subject invention on;

FIG. 3 is a perspective view of a wearer with the gown of the subject invention on, prior to removal of the tabs;

FIG. 4 is a partial plan view of the gown of the subject invention showing a person grasping the removable tab;

FIG. 5 is a partial plan view of the subject invention showing a person tearing the removable tab off;

FIG. 6 is a perspective view of a second embodiment of the removable tab of the gown of the subject invention.

DETAILED DESCRIPTION

Referring now to FIG. 1, there is shown a disposable surgical gown 10 formed of a non-woven fabric or the like and having arms or sleeves 11, a body portion 21 with a left side portion 12 and a right side portion 18. The neck of the surgical gown 10 may have a hem or other edging material 21. The interior surface 20 of the gown 10 is shown in FIG. 1. Secured to the interior 20 of the gown 10 are interior tie straps 14 and 15. Neck fastening strips 26 and 32 and waist fastening strips 17 and 31, respectively, are secured to the outside surface of left gown portion 18 and the inside surface of right gown portion 12 by adhesive or the like. Such fastening strips are preferably of material which adheres when pressed together, such as Velcro® which comprises mating hooks and loops on opposing strips.

Tear-away tabs 13 and 25 are secured to the outside surface of the right side portion 12 of the surgical gown 10, directly overlaying the fastening strips 17 and 26, respectively. The pull tab, generally extending out of the plane of the gown's outer surface, may be in the shape of a "T" as shown in FIG. 6 having an upstanding or gripping portion 37 secured to a base portion 36.

In one embodiment, the base portion is secured to the exterior surface of the gown through adhesive or the like. Upon utilization of the pull tab to bring the fastening means into contact for adherence, the entire tab may be removed from the gown surface.

In a second embodiment, the base portion of the tab is separated from the "T" or upstanding portion by perforations or other scoring means 39 for forming a sharp demarcation line. The "T" or upstanding portion 37 is formed of a relatively stiff material such as cardboard or the like. The base portion may be formed of a resilient tape material, or of cardboard, as desired. The perforations in the base portion allow the easy removal of the T-portion after closing the two gown sides. Removable tab 25 about the neck portion of the surgical gown is similar in structure and materials to tab 13, described above.

The manner of donning the surgical gown of the subject invention is as follows: the surgeon places his arms through the sleeves and stands in the position shown in FIG. 2, The circulating nurse, who generally is non-sterile, ties the inner tie strings 14 and 15 so that the knot is placed to the side of the surgeon. By utilizing the interior tie, adjustments may be made for different waist sizes without the neccessity of bunching material at the surgeon's side, thus the utilization of the interior tie allows greater flexibility in the use of one side of the surgical gown for a plurality of wearer sizes.

The opposing gown sides are then closed by grabbing the T-portions at both the neck and waist, pulling the right gown side over the left gown side and pushing in until contact of the fastening strips is achieved.

Utilization of tabs 13 and 25 in closing the surgical gown limits all contact to the upstanding tab portion 37 of tabs 13 and 25. The T-portion is then pulled downwardly, tearing the tab from the surgical gown at the perforated line 39. In the embodiment without the perforations, the entire tab is removed from the gown. The same procedure is followed for tab 13, thereby causing the surgical gown to completely encircle and cover the surgeon and be secured at both the neck and waist areas.

Fastening strips 32 and 31 may be of appropriate length to allow the gown to be adjustable in size for equal comfort to all wearers regardless of their size.

By the above structure in utilizing the above procedure in putting the surgical gown on, the surgeon does not present any contaminated exterior surface for contact with the operating table and apparatus and, in addition, by the elimination of exterior ties, particulate matter, such as lint, which generally can transfer from the exterior belt material, cannot adhere to the surgeon's otherwise sterile gloves with the use of the subject invention.

While the invention has been described with reference to a preferred embodiment, it will be understood by those skilled in the art that various changes may be made and equivalents may be substituted for element thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out the invention, but that the invention will include all embodiments falling within the scope of the appended claims.

I claim:

1. A surgical gown comprising a body having sleeves attached thereto, said body having a central panel and first and second side panels, said body having inner tie strings for securing said gown about the waist of a wearer, fastening means for releasably securing said first side panel over said second side panel and tab means secured to an outer surface of said first side panel, said tab means having a grip portion extending out of the plane of said outer surface of said first side panel for easy contact and manual retention, said tab means being releasably secured to said outer surface for easy removal whereby a person may aid the wearer to don said surgical gown without contaminating the outer surface of said gown by tying said interior ties, grasping said grip portion of said tab means, pulling said first side portion over said second side portion to engage said fastening means by pulling said grip portion and removing said tab means from said gown.

2. The gown of claim 1 wherein said fastening means comprise strips of mating surfaces on each of said first side panel and said second side panel, said strips being of a material that adhere when pressed together.

3. The gown of claim 1 wherein said tab means is generally T-shaped.

4. The gown of claim 1 wherein a base portion is adhesively secured to said outer surface of said gown and connected to said tab means.

5. The gown of claim 4 wherein said base means is attached to said tab portion through a perforated line.

6. The gown of claim 5 wherein said tab means is releasably secured to said base portion for removal of said tab means from said base portion by pulling said grip portion.

7. The gown of claim 4 wherein said base portion and said tab means are removable in one piece from said gown by pulling said grip portion.

8. A disposable surgical gown generally formed on non-woven fabric and capable of easy placement on a wearer while preventing contamination of an outer gown surface, said gown comprising a body having sleeves attached thereto, said body having a central panel and first and second side panels, said gown having inner tie strings for securing said gown about the waist of a wearer, fastening strips on an inside surface of said first side panel and an outside surface of said second side panel, said fastening strips being of a material that adhere when pressed together, thereby releasably securing said first side panel over said second side panel, and tab means secured to an outer surface of said first side panel generally overlaying said fastening strip, said tab means having a grip portion extending out of the plane of said outer surface of said first side panel for contact and manual retention, said tab means being releasably connected to said outer surface of said first side panel for easy removal whereby a person may aid the wearer to don said surgical gown without contaminating the outside surface of said gown by tying said interior tie strings, grasping said grip portion of said tab means, pulling said first side portion with said tab means over said second side portion to engage said fastening means by pulling said grip portion, and removing said strip portion from said tab means.

9. The gown of claim 8 wherein said tab means includes a base portion, said base portion being secured to said outer surface of said first portion and separated from the remainder of said tab means by perforations for allowing the removal of the remainder of said tab means by tearing along said perforations.

10. The gown of claim 9 wherein said base portion is formed of a resilient tape means and is secured to each of said outer surfaces of said first portion and said grip portion, said perforations being intermediate said grip portion and said base portion.

11. The gown of claim 8 wherein said tab means includes a base portion, said base portion being adhesively secured to said outer surface of said first portion and entirely removable therefrom.

* * * * *